US010687143B2

(12) United States Patent
Ozcan

(10) Patent No.: US 10,687,143 B2
(45) Date of Patent: Jun. 16, 2020

(54) MONITORING AND CORRECTING APPARATUS FOR MOUNTED TRANSDUCERS AND METHOD THEREOF

(71) Applicant: Nokia Technologies Oy, Espoo (FI)

(72) Inventor: Koray Ozcan, Farnborough (GB)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/980,148

(22) Filed: May 15, 2018

(65) Prior Publication Data

US 2019/0141448 A1 May 9, 2019

Related U.S. Application Data

(63) Continuation of application No. 14/990,862, filed on Jan. 8, 2016, now Pat. No. 9,980,047, which is a continuation of application No. 13/519,290, filed as application No. PCT/EP2009/068056 on Dec. 31, 2009, now Pat. No. 9,253,584.

(51) Int. Cl.

| | |
|---|---|
| ***H04R 29/00*** | (2006.01) |
| ***H04R 3/08*** | (2006.01) |
| ***H04R 3/00*** | (2006.01) |

(52) U.S. Cl.

CPC ..... *H04R 3/08* (2013.01); *H04R 3/007* (2013.01); *H04R 29/001* (2013.01); *H04R 29/003* (2013.01); *H04R 2499/11* (2013.01)

(58) Field of Classification Search

CPC ..... H03G 11/00; H04R 3/007; H04R 29/00; H04R 29/001; H04R 29/002; H04R 29/003; H04R 29/004; H04R 29/005; H04R 29/006; H04R 29/007; H04R 29/008; H04R 25/30; H04R 25/305; H04R 25/70; H04R 2410/03; H04R 3/00; H04R 3/002; H04R 3/02; H04R 3/06; H04R 3/08; H04R 3/04; H04R 3/07; H04R 1/1083

USPC ..... 381/55, 56, 58, 59, 94.9, 60; 455/67.11, 455/67.12; 700/94

See application file for complete search history.

(56) References Cited

U.S. PATENT DOCUMENTS

| | | | | |
|---|---|---|---|---|
| 4,751,739 | A | 6/1988 | Serikawa et al. | |
| 5,015,969 | A | 5/1991 | Barclay et al. | |
| 5,255,324 | A | 10/1993 | Brewer et al. | |
| 5,652,542 | A | 7/1997 | Fink | |
| 6,584,204 | B1 | 6/2003 | Al-Ali et al. | |
| 6,668,204 | B2 * | 12/2003 | Neoh | H04R 5/033 381/112 |
| 6,798,889 | B1 | 9/2004 | Dicker et al. | 381/303 |

(Continued)

FOREIGN PATENT DOCUMENTS

| | | |
|---|---|---|
| EP | 0616425 B1 | 11/1998 |
| EP | 1523218 A1 | 4/2005 |

(Continued)

OTHER PUBLICATIONS

Brown et al., "A New Model for Updating Software in Wireless Sensor Networks", IEEE Network, vol. 20, Issue 6, Nov.-Dec. 2006, pp. 42-47.

(Continued)

*Primary Examiner* — Leshui Zhang
(74) *Attorney, Agent, or Firm* — Harrington & Smith

(57) ABSTRACT

An apparatus comprises at least one processor and at least one memory including computer program code the at least one memory and the computer program code configured to, with the at least one processor, cause the apparatus at least to perform; monitoring at least one indicator dependent on a transducer mechanical integration parameter; and determining a change in the at least one indicator.

17 Claims, 6 Drawing Sheets

(56) References Cited

U.S. PATENT DOCUMENTS

| | | | | |
|---|---|---|---|---|
| 2004/0017921 | A1* | 1/2004 | Mantovani | H03G 5/22 381/94.9 |
| 2004/0234079 | A1 | 11/2004 | Schneider | 381/58 |
| 2005/0069161 | A1* | 3/2005 | Kaltenbach | H04M 9/082 381/312 |
| 2005/0238178 | A1* | 10/2005 | Garcia | H04R 29/001 381/59 |
| 2007/0025557 | A1 | 2/2007 | Naokvi et al. | 381/59 |
| 2007/0211652 | A1* | 9/2007 | Minamiguchi | H04B 3/234 370/286 |
| 2007/0269057 | A1 | 11/2007 | Ding | 381/107 |
| 2008/0056504 | A1 | 3/2008 | Gorges et al. | 381/55 |
| 2010/0272272 | A1 | 10/2010 | Muller | 381/60 |

FOREIGN PATENT DOCUMENTS

| | | | | |
|---|---|---|---|---|
| EP | 1923864 | A2 | | 5/2008 |
| JP | 2007-124203 | A | | 5/2007 |
| JP | 2007124203 | A | * | 5/2007 |
| JP | 2009-141885 | A | | 6/2009 |
| WO | WO-2001/026222 | A1 | | 4/2001 |
| WO | WO-2007/073341 | A2 | | 6/2007 |

OTHER PUBLICATIONS

Moessner et al., "Terminal Reconfigurability—The Software Download Aspect", First International Conference on 3G Mobile Communication Technologies, 2000, pp. 326-330.

Hughes, "Impedance Measurement", Audio & Acoustical Consulting, Design and Measurement, May 11, 2007, pp. 1-10.

Colloms, "Mis-termination", High Performance Loudspeakers, Fourth Edition, Apr. 12, 1991, pp. 276-277.

"Measuring Thiele/Small Loudspeaker Parameters", Measuring Loudspeaker Parameters, Retrieved on Jun. 19, 2013, Webpage available at: http://sound.westhost.com/tsp.htm.

* cited by examiner

MONITORING AND CORRECTING APPARATUS FOR MOUNTED TRANSDUCERS AND METHOD THEREOF

CROSS-REFERENCE TO RELATED APPLICATIONS

The application is a continuation of application Ser. No. 14/990,862, filed Jan. 8, 2016 which is a continuation of application Ser. No. 13/519,290, filed Jun. 26, 2012, which is the National Stage of International application No. PCT/EP2009/068056, filed Dec. 31, 2009, the disclosures of which are hereby incorporated by reference in their entireties.

The present application relates to a method and apparatus. In some embodiments the method and apparatus relate to detecting a parameter change for a transducer in mechanical integration in apparatus.

Some portable electronic devices comprise transducers operated in combination with suitably designed resonant cavities to produce loudspeakers and/or earpieces. The integration of transducers and cavities are required to be small in size. Transducers are important components in electronic devices such as mobile phones for the purposes of playing back music or having a telephone conversation. The quality and loudness of a transducer in an electronic device are important especially if a user listens to sounds generated by an electronic device at a distance from the electronic device.

The transducer is typically the end of a chain of apparatus and/or processing used to generate acoustic waves from an audio source. The acoustic designs for transducers are typically completed on reference prototype products by designers. For example, the design of an integrated hands free (IHF) speaker starts with hardware (HW) integration. The hardware integration design issues include the designing of acoustic apertures designed appropriately to include cavities, outlets, channels, seals in order to create the required ear speaker and hands free frequency response and volume response characteristics. After hardware integration comes typically the baseband (BB) electronic design (such as analogue gain stages etc). The following stage of design once the hardware integration and base band electronic design is completed is the software (SW) design stage which involves designing and implementing the algorithms and filters such as digital signal processing (DSP) equalization (EQ), dynamic range compression (DRC), in order to overcome or adapt the limitations of the hardware integration issues. For example due to the small size of the hardware integration volume available to the designer BB and the SW design stages are required to convert the audio signal received into a format which when passed to the transducer produces the required acoustic signal similar to a conventional loudspeaker but with significantly smaller cavity volume. In some designs the BB and SW design may be performed simultaneously.

It is typical to design the SW components such as equalization using static characteristics determined from the original designed HW characteristics. Designers however also provide a certain tolerance band around a target EQ design in order to allow for mass production tolerances. However the specific characteristics of a single implementation is not optimized and also other elements introduced during mass production; such as tooling related aspects, component tolerance bands, assembly related matters are not typically considered.

Thus the SW components are not typically designed to take into account any one specific transducer or HW measurement only the general transducer and HW integration and thus the equalization may not produce an audio output with a true high fidelity.

Furthermore the audio playback produced by the transducer and HW components may further deviate from the expected when aging or other random events occur. For example, during the product life cycle, the apparatus containing the transducer may be dropped or experience other impacts or shocks. As a result of such impacts, certain mechanical features such as gaskets, seals, positions could change in position which would produce an unwanted HW change and thus influence the playback quality and may cause a reduced loudness or deviation from expected frequency response.

Aside from accidents mechanical audio components age and may fail. The aging and the failure of such mechanical audio components is currently difficult to diagnose. For example when a user returns their apparatus to a service centre, it is difficult to diagnose the core of the problem without making extensive and often expensive disassembly procedures. The failure and the field return may be due to software issues, the transducer, or other mechanical features such as broken seals, gaskets etc.

Furthermore as the user perceives the returning of the apparatus to the manufacturer as a difficulty they may temporarily 'put up with' the faulty apparatus before discarding an otherwise usable apparatus without informing the manufacturer of the issue. In such circumstances the manufacturer may not receive sufficient information to determine the cause of the problem such as how many failures are due to transducer or its mechanical integration. In addition, production tests at assembly may not capture these defects or possible that any defect can be initiated or worsen over time, for example, user may drop the apparatus and dislodge a seal which over time may cause a further component to fail.

Embodiments of the present invention aim to address one or more of the above problems.

In a first aspect of the invention there is a method comprising: monitoring at least one indicator dependent on a transducer mechanical integration parameter; and determining a change in the at least one indicator.

The at least one indicator may comprise at least one of: a transducer electrical impedance; at least one Theiele-Small parameter; and a captured audio signal generated by the transducer mechanical integration.

Monitoring the at least one indicator may comprise: selecting an audio signal; playing the audio signal using the transducer mechanical integration; and determining the at least one indicator as the audio signal is playing.

The monitoring the at least one indicator may further comprise associating the at least one indicator with an audio signal frequency, so as to determine the at least one indicator over a frequency range.

Determining a change in the indicator may comprise at least one of: determining a significant difference between the indicator and a previously determined indicator; determining a significant difference between the indicator and a design specification indicator; and determining a significant match between the indicator and at least one of a set of predetermined indicators identifying a transducer mechanical integration fault.

The method may further comprise: determining the change in the indicator is rectifiable; determining at least one rectification parameter; applying the at least one rectification parameter to reduce the change in the indicator.

The rectification parameter may comprise at least one equalization filter coefficient, wherein applying the rectification parameter comprises filtering an audio signal prior to playing the audio signal on the transducer using the at least one equalization filter coefficient.

The method may further comprise: determining the change is not rectifiable; and generating a fault indicator associated with the change in the indicator.

The method may further comprise entering a calibration mode of operation prior to monitoring the indicator, wherein entering the calibration mode of operation is triggered by at least one of: receiving a calibration message; detecting a predetermined date/time assigned for calibration testing; detecting an significant acceleration and/or deceleration; and detecting an operating life-time value.

The method may further comprise transmitting to an apparatus the change in the at least one indicator.

Transmitting to an apparatus the change in the at least one indicator may comprise transmitting the change to at least one of: a service centre; a manufacturer diagnosis server; a personal computer.

Transmitting to an apparatus the change in the at least one indicator may comprise transmitting a short message service message comprising the at least one indicator.

The method may comprise monitoring at least one indicator dependent on a transducer mechanical integration parameter in a first apparatus comprising the transducer; and determining a change in the at least one indicator in a further apparatus separable from the first apparatus.

According to a second aspect of the invention there is provided an apparatus comprising at least one processor and at least one memory including computer program code the at least one memory and the computer program code configured to, with the at least one processor, cause the apparatus at least to perform: monitoring at least one indicator dependent on a transducer mechanical integration parameter; and determining a change in the at least one indicator.

The at least one indicator may comprise at least one of: a transducer electrical impedance; at least one Theiele-Small parameter; and a captured audio signal generated by the transducer mechanical integration.

Monitoring the at least one indicator may cause the apparatus at least to perform: selecting an audio signal; playing the audio signal using the transducer mechanical integration; and determining the at least one indicator as the audio signal is playing.

Monitoring the at least one indicator may cause the apparatus at least to further perform at least one of: associating the at least one indicator with an audio signal frequency, so as to determine the at least one indicator over a frequency range.

Determining a change in the indicator may cause the apparatus at least to perform at least one of: determining a significant difference between the indicator and a previously determined indicator; determining a significant difference between the indicator and a design specification indicator; and determining a significant match between the indicator and at least one of a set of predetermined indicators identifying a transducer mechanical integration fault.

The at least one memory and the computer program code configured to, with the at least one processor, may cause the apparatus at least to further perform: determining the change in the indicator is rectifiable; determining at feast one rectification parameter; and applying the at least one rectification parameter to reduce the change in the indicator.

The rectification parameter may comprise at least one equalization filter coefficient, wherein applying the rectification parameter may cause the apparatus at least to perform filtering an audio signal prior to playing the audio signal on the transducer using the at least one equalization filter coefficient.

The at least one memory and the computer program code configured to, with the at least one processor, may cause the apparatus at least to further perform: determining the change is not rectifiable; and generating a fault indicator associated with the change in the indicator.

The at least one memory and the computer program code may be configured to, with the at least one processor, cause the apparatus at least to further perform entering a calibration mode of operation prior to monitoring the indicator, wherein entering the calibration mode of operation is preferably triggered by at least one of: receiving a calibration message; detecting a predetermined date/time assigned for calibration testing; detecting an significant acceleration and/or deceleration; and detecting an operating life-time value.

The at least one memory and the computer program code may be configured to, with the at least one processor, may cause the apparatus at least to further perform transmitting to a further apparatus the change in the at least one indicator.

The at least one memory and the computer program code may be configured to, with the at least one processor, may cause the apparatus at least to further perform transmitting to at least one of: a service centre; a manufacturer diagnosis server; a personal computer.

The at least one memory and the computer program code may be configured to, with the at least one processor, may cause the apparatus at least to further perform transmitting a short message service message comprising the at least one indicator.

The at least one memory and the computer program code may be configured to, with the at least one processor, may cause the apparatus at least to further perform monitoring at least one indicator dependent on a transducer mechanical integration parameter in the apparatus comprising the transducer; wherein determining a change in the at least one indicator comprises receiving from a further apparatus separable from the first apparatus a determination of the change in the at least one indicator.

According to a third aspect of the invention there is provided an apparatus comprising: a transducer parameter monitor configured to monitor at least one indicator dependent on a transducer mechanical integration parameter; and an audio signal parameter controller configured to determine a change in the at least one indicator.

The transducer parameter monitor may further comprise: an audio signal selector configured to select a calibration audio signal; an audio signal generator configured to play the calibration audio signal using the transducer mechanical integration; and an indicator determiner configured to determine the at least one indicator as the audio signal is playing.

The indicator determiner may comprise a transducer impedance detector configured to monitor at least one of the potential difference across the transducer and the current through the transducer and determine the impedance of the transducer.

The indicator determiner may comprise a transducer Theiele-Small parameter determiner configured to determine at least one Theiele-Small parameter.

The indicator determiner may comprise a microphone configured to capture an audio signal generated by the transducer mechanical integration.

The transducer parameter monitor may comprise an indicator frequency response processor configured to associate the at least one indicator with an audio signal frequency, to determine the at least one indicator over a frequency range.

The audio signal parameter controller may comprise at least one of: a relative indicator difference determiner configured to determine a significant difference between the indicator and a previously determined indicator; an absolute indicator difference determiner configured to determine a significant difference between the indicator and a design specification indicator; and a fault match determiner configured to determine a significant match between the indicator and at least one of a set of predetermined indicators identifying a transducer mechanical integration fault.

The audio signal parameter controller may comprise a parameter rectifier configured to: determine the change in the indicator is rectifiable; and determine at least one rectification parameter; and the apparatus may further comprise an audio signal processor configured to apply the at least one rectification parameter to reduce the change in the indicator.

The rectification parameter may comprise at least one equalization filter coefficient, wherein the audio signal processor may be configured to perform filtering an audio signal prior to playing the audio signal on the transducer using the at least one equalization filter coefficient.

The apparatus may further comprise a fault diagnosis processor configured to determine the change is not rectifiable; and generate a fault indicator associated with the change in the indicator.

The indicator determiner may comprise a calibration mode determiner configured to trigger a calibration mode dependent on at least one of: receiving a calibration message; detecting a predetermined date/time assigned for calibration testing; detecting an significant acceleration and/or deceleration; and detecting an operating life-time value.

The apparatus further comprises a transmitter configured to transmit to a further apparatus the change in the at least one indicator.

The transmitter may comprise transmitting the change in the at least one indicator to at least one of: a service centre; a manufacturer diagnosis server; a personal computer.

The apparatus comprises a first apparatus configured to monitor the at least one indicator dependent on a transducer mechanical integration parameter in the apparatus comprising the transducer; and receiving from a second apparatus separable from the first apparatus a determination of the change in the at least one indicator.

According to a fourth aspect of the invention there is provided an apparatus comprising: a monitoring means configured to monitor at least one indicator dependent on a transducer mechanical integration parameter; and indicator detection means configured to determine a change in the at least one indicator.

According to a fifth aspect of the invention there is provided a computer-readable medium encoded with instructions that, when executed by a computer perform: monitoring at least one indicator dependent on a transducer mechanical integration parameter; and determining a change in the at least one indicator.

An electronic device may comprise apparatus as described above.

A chipset may comprise apparatus as described above.

For a better understanding of the present application and as to how the same may be carried into effect, reference will now be made by way of example to the accompanying drawings in which.

The following describes apparatus and methods for monitoring the performance of a transducer to improve fault diagnosis and recovery.

The embodiments of this application monitor the acoustic load change of transducers by utilizing electrical measurements. The monitoring may in some embodiments be implemented by an analogue implementation, assisted by software and/or control mechanisms which monitor the acoustic load. For example, any failure of gaskets/seals which typically would help to form the rear volume may influence the resonance frequency.

In some embodiments the reference impedance characteristics can be stored in the memory and if the acoustic load changes from this reference value due to mass production tolerances, gaskets/seal failures, or wrong positioning of the mechanical components, the system may determine this by measuring the electrical impedance; comparing the measured electrical impedance parameters against the reference values. The electrical impedance may in some embodiments be used to represent the frequency response of the design. Furthermore in some embodiments the use of electrical impedance as frequency response may be used in audio software updates as the digital parameters used in the software updates could be updated adaptively to any determined acoustic load change.

Figure 1:
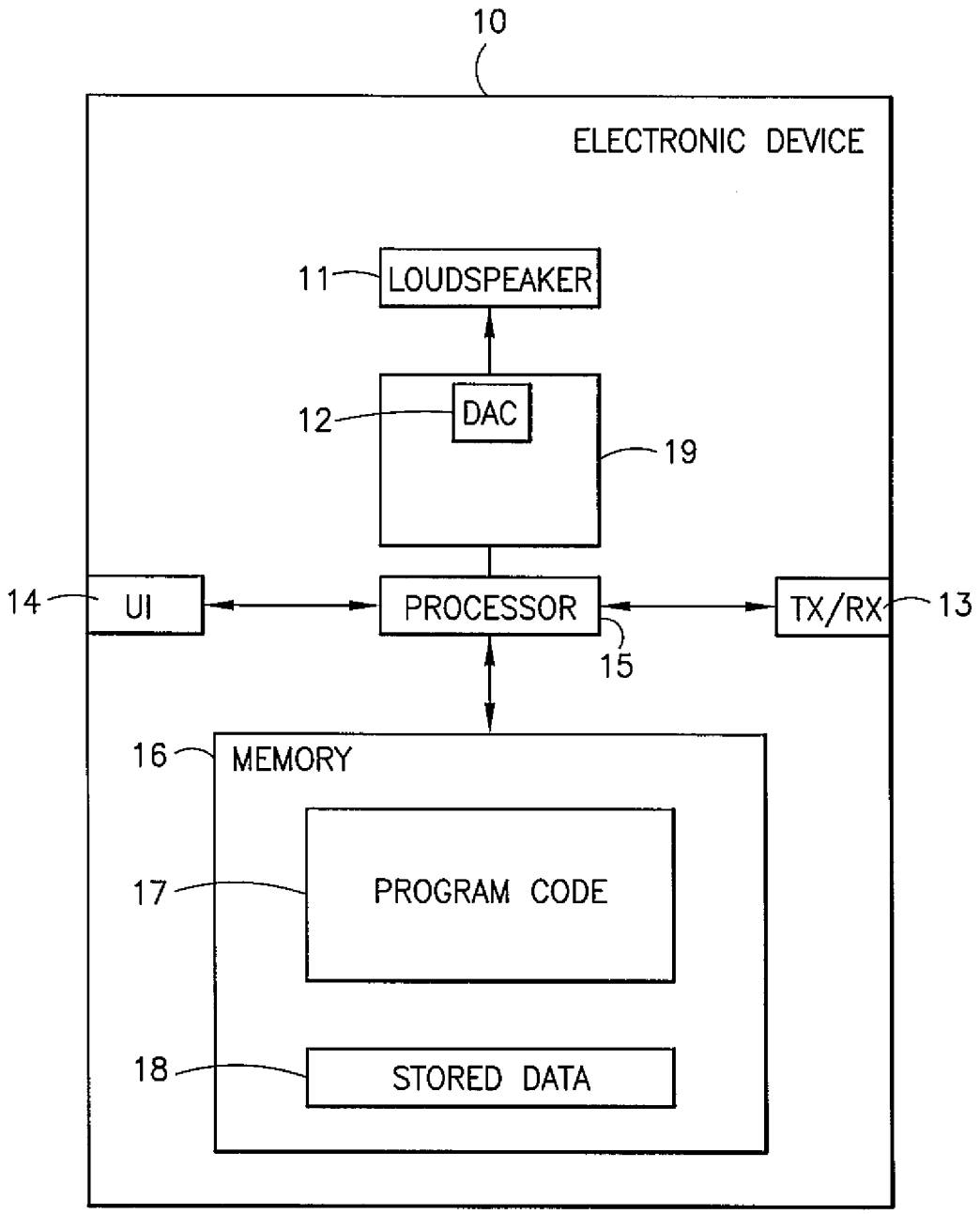
FIG. 1 shows a schematic block diagram of an apparatus according to some embodiments.

FIG. 1 discloses a schematic representation of an electronic device or apparatus 10 comprising a transducer 11. The transducer 11 may be an integrated speaker such as an integrated hands free speaker, (IHF), loudspeaker or an earpiece.

The transducer 11 may be a dynamic or moving coil, a piezoelectric transducer, an electrostatic transducer or a transducer array comprising microelectromechanical systems (MEMS). Additionally or alternatively the transducer comprises a multifunction device (MFD) component having any of the following; combined earpiece, integrated hands-free speaker, vibration generation means or a combination thereof.

The apparatus 10 in some embodiments may be a mobile phone, portable audio device, or other means for playing sound. The apparatus 10 has a sound outlet for permitting sound waves to pass from the transducer 11 to the exterior environment.

The apparatus 10 is in some embodiments a mobile terminal, mobile phone or user equipment for operation in a wireless communication system.

In other embodiments, the apparatus 10 is any suitable electronic device configured to generate sound, such as for example a digital camera, a portable audio player (mp3 player), a portable video player (mp4 player). In other embodiments the apparatus may be any suitable electronic device with a speaker configured to generate sound.

In some embodiments, the apparatus 10 comprises a sound generating module 19 which is linked to a processor 15. The processor 15 may be configured to execute various program codes. The implemented program codes may comprise a code for controlling the transducer 11 to generate sound waves.

The implemented program codes in some embodiments 17 may be stored for example in the memory 16 for retrieval by the processor 15 whenever needed. The memory 16 could further provide a section 18 for storing data, for example data that has been processed in accordance with the embodiments. The code may, in some embodiments, be implemented at least partially in hardware or firmware.

In some embodiments the sound generating module 19 comprises a digital-to-analogue converter (DAC) 12 configured to convert the digital audio signals to the transducer 11. The digital to analogue converter (DAC) 12 may be any suitable converter.

In some embodiments the DAC 12 may send an electronic audio signal output to the transducer 11 and on receiving the audio signal from the DAC 12, the transducer 11 generates acoustic waves. In other embodiments, the apparatus 10 may receive control signals for controlling the transducer 11 from another electronic device.

The processor 15 may be further linked to a transceiver (TX/RX) 13, to a user interface (UI) 14 and to a display (not shown).

The transceiver 13 may be configured to communicate to other apparatus wirelessly using a suitable wireless communication protocol. For example where the apparatus may communicate using the transceiver via a base station using an universal mobile telecommunications system (UMTS) protocol.

The user interface 14 may enable a user to input commands or data to the apparatus 10. Any suitable input technology may be employed by the apparatus 10. It would be understood for example the apparatus in some embodiments may employ at least one of a keypad, keyboard, mouse, trackball, touch screen, joystick and wireless controller to provide inputs to the apparatus 10.

Figure 2:
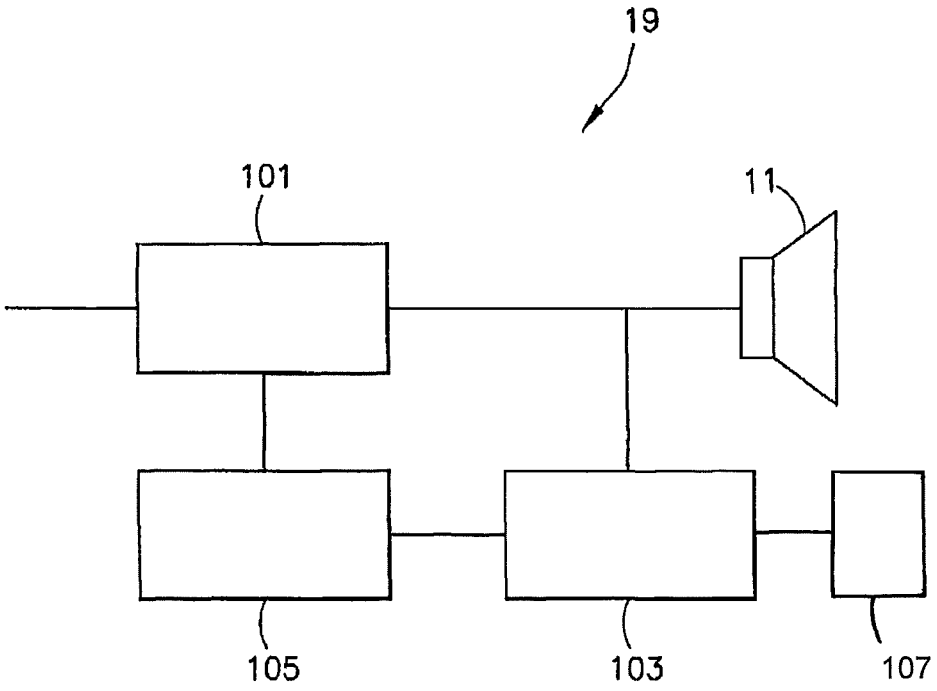
FIG. 2 shows a schematic block diagram of an apparatus shown in FIG. 1 in further detail.

With respect to FIG. 2 the sound generating module 19 and transducer is schematically shown in further detail. Furthermore the operation of the sound generating module 19 according to some embodiments of the application are described with respect to the FIGS. 3 to 7.

Figures 3, 4:
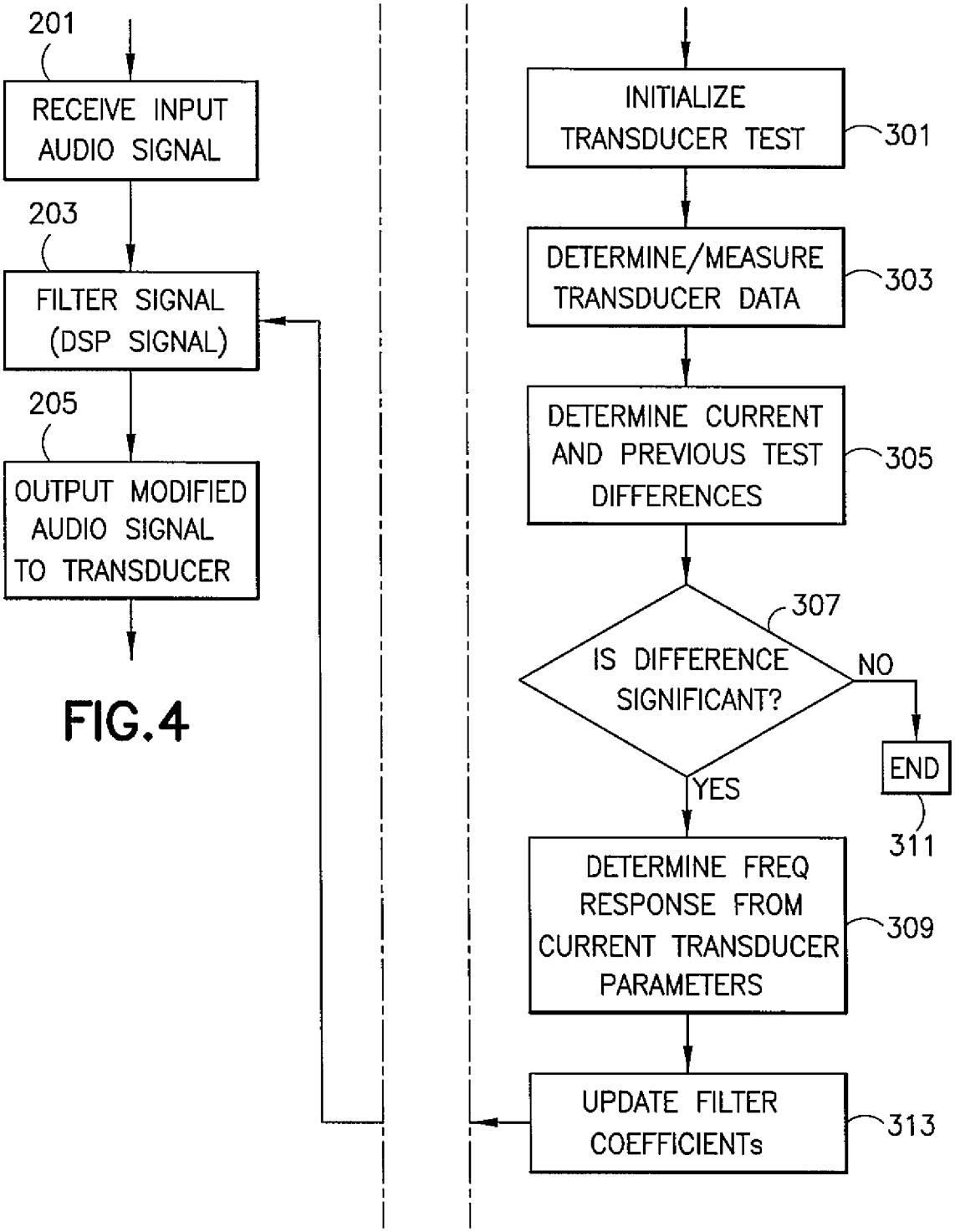
FIG. 3 shows a flow diagram of operations performed by the apparatus according to some embodiments.
FIG. 4 shows a flow diagram of filtering operations performed by the apparatus according to some embodiments.

With respect to FIG. 3 an overview of the operation of the sound generating module 19 with respect to some embodiments is shown.

The sound generating module 19 in some embodiments comprises a transducer parameter monitor 103. In some embodiments the transducer parameter monitor 103 is configured to receive a control signal and activate a calibration mode for the apparatus or initialize a transducer test. In some embodiments the sound generating module 19 may receive the control signal from the processor 15. The processor 15 may generate the control signal to activate the calibration mode dependent on any suitable trigger event. Thus in some embodiments the trigger event may be time or date related. For example the processor may generate the control signal after a predetermined number of hours of use and/or at predetermined dates on the calendar. In some embodiments the trigger event to signal or indicate the calibration mode may be configured to be automatic (for example the time and/or date triggering described above which is predetermined by the apparatus without any assistance of the user), semi-automatic (in other words configured to operate at times/dates set by the user of the apparatus), or manually by the user of the apparatus by means of a suitable input from the user. For example if the user suspects that the playback of the device has become worse the user may initialize a calibration mode to determine if the apparatus has a fault.

In some embodiments a calibration mode may be initialized following the user placing the apparatus in a calibration box, which in some embodiments may be part of the packaging within which the apparatus is originally supplied. For example the packaging box may comprise a radio frequency identifier (RFID) module which when detected by the apparatus initializes the calibration mode.

In other embodiments the calibration box is a box typically available to the user such as a commonly available piece of kitchenware.

In some embodiments the calibration mode may be initialized following a received message, such as a short message service (sms) message informing the apparatus to carry out a calibration test.

In some other embodiments the calibration mode may be initialized after a shock sensor, such as an accelerometer, determines that the apparatus has experienced a physical shock or deceleration such as being dropped from a height or struck with sufficient force that there is a possibility of physical damage to the transducer or other hardware audio component.

The operation of initializing the transducer test is shown in FIG. 3 by step 301.

The transducer parameter monitor 103 is configured to monitor a transducer parameter. In some embodiments the transducer parameter monitor is configured to measure or monitor the impedance of the transducer 11.

Figure 6:
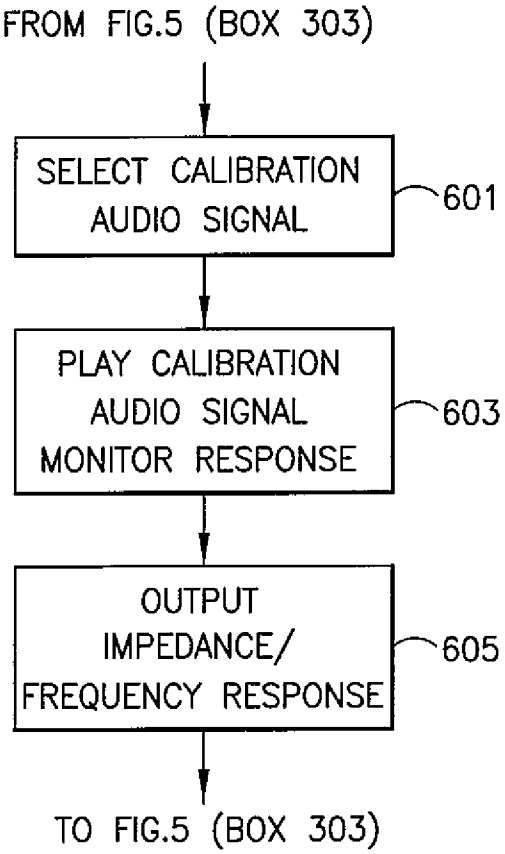
FIG. 6 shows a flow diagram of calibration mode testing operations performed by the apparatus according to some further embodiments.

With respect to FIG. 6 the test or measuring operation of the transducer parameter monitor 103 as shown in FIG. 2 with respect to some embodiments is described in more detail.

The transducer parameter monitor 103 may be configured to select a suitable calibration audio signal to be output while monitoring the transducer 11. The suitable calibration audio signal may be for example a sweep sine wave, at full scale. The calibration audio signal may be a digital signal stored in the apparatus memory 16 and only used for calibration. In other embodiments the calibration audio signal is a music signal with suitable frequency components. For example the calibration audio signal may be any audio signal where the audio signal characteristics are known for example the audio signal may be a white noise audio signal, a pink noise-audio signal, a maximum length sequence (MLS) audio signal (in other words an audio signal which contains all of the measurable frequency components).

In some other embodiments, the calibration audio signal may be a multiple frequency tone burst or a noise burst. The transducer parameter monitor 103 may in these embodiments measure and analyse only those selected frequencies which may be the most critical frequencies such as those frequencies which define key resonances of the transducer.

The operation of selection of the calibration audio signal is shown in FIG. 6 by step 601.

The calibration audio signal is then played. In other words the calibration audio signal is input to the sound generating module 19 and output to the transducer 11. In some embodiments the sound generating module 19 operates in the calibration mode with a bypass mode on the transducer control module 101. In other words the calibration audio signal is passed to the transducer 11 un-equalized and without any digital signal processing applied to the calibration audio signal. In some embodiments the calibration mode performs a first operation with the transducer control module 101 operating and a second operation with the transducer control module 101 not performing any digital signal processing on the calibration audio signal processing to monitor the effect of the transducer control module 101.

The transducer parameter monitor then performs the operation of monitoring while the calibration audio signal is being played.

In some embodiments the transducer parameter monitor 103 monitors the impedance of the transducer 11 as the calibration audio signal is played. In such embodiments the impedance of the transducer such as those used as an integrated hands free speaker (IHF), earpiece would capture information on the transducer and also the acoustic load associated with the hardware integration design. The acoustic load may be defined by the mechanical arrangements such as the acoustic cavities associated with the transducers 11 and any gaskets, seals, outlets etc. The impedance response would vary depends on the condition of the system in the apparatus.

Figure 8:
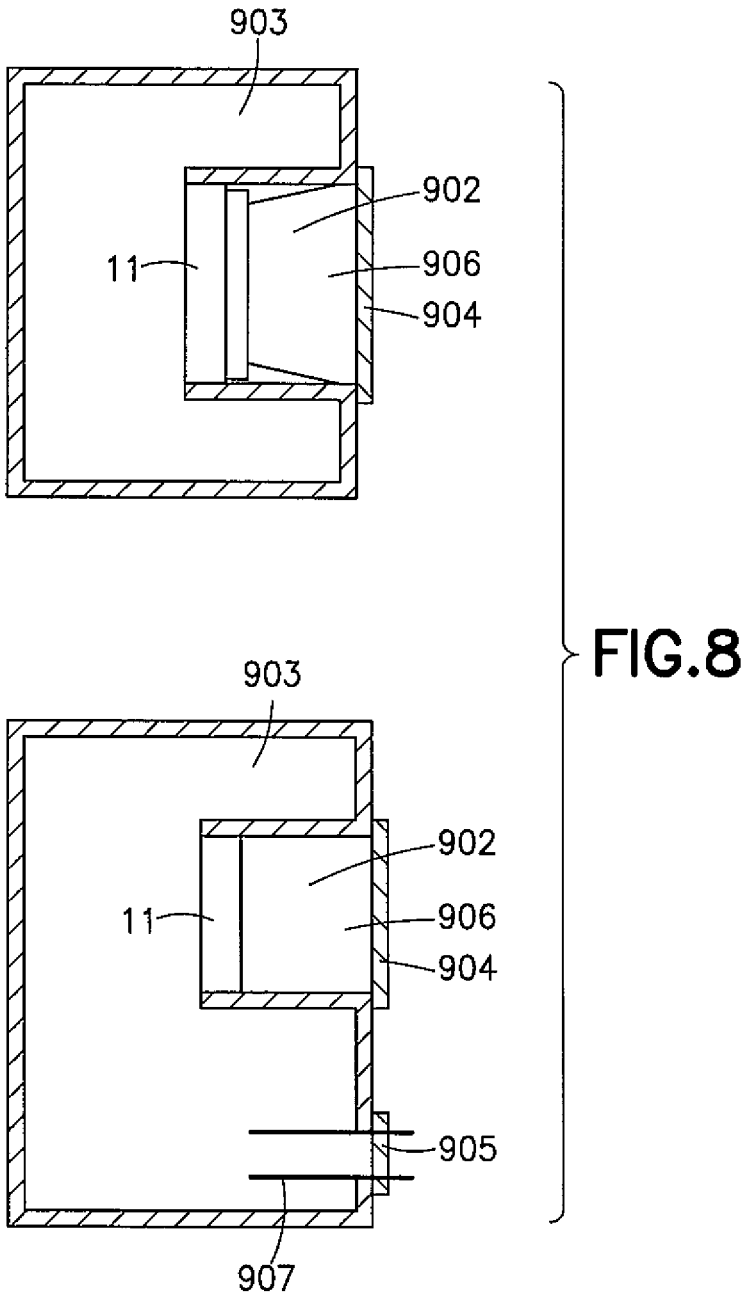
FIG. 8 shows a schematic block diagram of the mechanical hardware Integration components of apparatus shown in FIG. 1 according to some embodiments.

For example some schematic systems are shown in FIG. 8 where the transducer 11 is located within the apparatus 10. The apparatus 10 is manufactured in such a way that the transducer 11 is configured to be located within the apparatus and defines a first open acoustic cavity 902 with an opening 906 for tuning and directing acoustic waves suitable for listening to when the apparatus is placed against the ear. The apparatus 10 further comprises an acoustic mesh 904 over the acoustic cavity 902 which further modifies the frequency response of the transducer.

The transducer in FIG. 8 is further located within the apparatus and defines a second acoustic cavity 903. In the first system (the upper arrangement) the second acoustic cavity (the rear cavity) is sealed. In the second system (the lower arrangement) the second acoustic cavity 903 is ported using a conduit 907 and covered by a removable seal 905 and may be configured to tunes and directs acoustic waves suitable for hands free operation listening.

It would be understood that any change to the apparatus affecting the cavities or meshes or openings would produce an effect on the physical loading when the transducer is in use. For example if the casing or gaskets or seals crack then the cavity is effectively retuned for different frequencies which would produce different loading characteristics in the transducer. Also it is possible that the mesh or grill 904,905 that would normally stop dust/water reaching the transducer 11 can become loose and change the acoustic characteristics of the hardware components. The change in the acoustic characteristics could be captured by the impedance measurement.

In some embodiments transducer parameter monitor 103 is configured to monitor the electrical impedance of the transducer by measuring a complex transfer function between voltage and current. In such embodiments the current through the transducer may be measured across a shunt resistor (for example a 1 Ohm resistor placed in series with the transducer 11), and the voltage may be measured across the transducer 11 terminals. The values of the voltage and current may then be conditioned and digitized prior to the determination of the transfer function.

In some embodiments the voltage and current values may be monitored in real time against the calibration signal and thus in some embodiments a series of transducer frequency response values may be determined where the impedance values compared against the frequency values of the calibration signal.

In some embodiments the transducer parameter monitor 103 may determine at least some of the Thiele-Small parameters ($f_S$, $Q_{ES}$, $Q_{MS}$, $V_{AS}$, $R_E$ & $S_D$) which are known to define the low frequency performance of the hardware integration.

For example the dc resistance Thiele-Small parameter $R_E$ may be determined by the transducer parameter monitor 103 by measuring the voltage across the speaker and the current through a shunt resistor as described above.

The transducer parameter monitor 103 may further in some embodiments determine the mechanical resonant frequency Thiele-Small parameter $f_S$ by using a frequency generator to output the calibration audio signal, or selecting the calibration audio signal to sweep the audio spectrum. The generator in such embodiments may set the calibration audio signal level to a maximum value (which does not exceed the rating of the speaker). As the generator sweeps the frequency spectrum the impedance of the transducer is monitored either using the apparatus and method described above or in some embodiments by monitoring the voltage level only as the voltage level is roughly proportional to the impedance of the transducer if the source impedance $R_G$ of the generator is much greater than that of the transducer.

The mechanical resonant frequency $f_S$ can be measured in some embodiments when the voltage ($V_{max}$) and therefore the impedance is at a maximum value. Furthermore in some embodiments where other Thiele-Small parameters are to be determined the audio signal generator sets the voltage across the speaker for the further tests to be the same as the maximum value as some parameters are level dependent (i.e. non-linear).

Furthermore either by sweeping the signal generator below $f_S$ until the level no longer decreases or reviewing the swept audio signal impedance values, the minimum impedance value is found. The minimum impedance value (which as described above) may be determined by the minimum voltage $V_{MIN}$. The transducer parameter monitor 103 may further determine a mid point (voltage $V_{MID}$) using the following equations:

$$V_{MID} = \frac{V_{MIN}}{1 - \alpha + \sqrt{\alpha(V_{MIN} / V_{MAX} + \alpha - 1)}}$$

where, $$\alpha = \frac{R_G}{R_G + R_E}.$$

The frequency at this point is $f_L$. The same level occurs again above $f_S$ at $f_U$.

The transducer parameter monitor 103 may further in some embodiments determine the mechanical Q of the suspension $Q_{MS}$ using the formula:

$$Q_{MS} = \frac{f_S}{f_U - f_L}\sqrt{\frac{\alpha V_{MAX}}{V_{MIN} - (1 - \alpha)V_{MAX}}}$$

and the transducer parameter monitor 103 may further in some embodiments determine the electrical Q, $Q_{ES}$ using:

$$Q_{ES} = \frac{V_{MIN} - (1-\alpha)V_{MAX}}{V_{MAX} - V_{MIN}} Q_{MS}.$$

In some embodiments where the source impedance of the generator is very large in comparison with the speaker, the transducer parameter monitor 103 may further in some embodiments determine the mid points as being approximated by:

$$V_{MID} \approx \sqrt{V_{MAX} V_{MIN}}$$

In which case the transducer parameter monitor 103 may further in some embodiments determine the $Q_{MS}$ using:

$$Q_{MS} \approx \frac{f_S \sqrt{V_{MAX} / V_{MIN}}}{f_U - f_L}$$

and the electrical Q, $Q_{ES}$ may be calculated using:

$$Q_{ES} \approx \frac{V_{MIN} Q_{MS}}{V_{MAX} - V_{MIN}}.$$

The transducer parameter monitor 103 may further in some embodiments determine the total Q of the suspension by:

$$Q_{TS} = \frac{Q_{ES} Q_{MS}}{Q_{ES} + Q_{MS}}.$$

The transducer parameter monitor 103 may further in some embodiments determine the quantity $V_{AS}$, the equivalent compliance volume, as the suspension equivalent volume of air. In other words, the volume of a box of air that exhibits the same compliance as the suspension when a force is exerted over the same area as the effective area of the diaphragm. It is not necessarily the optimum enclosure volume. In fact a sealed enclosure of volume $V_{AS}$ raises $f_S$ by a factor of $\sqrt{2}$ because the compliance is halved and $f_S$ is given by the formula:

$$f_S = \frac{1}{2\pi\sqrt{M_{MD} C_{MS}}}$$

If the transducer is mounted in a sealed box of known volume $V_B$, then the frequency at which the maximum reading occurs will increase to a new frequency $f_B$. $V_{AS}$ may be calculated by the transducer parameter monitor 103 in some embodiments using the formula:

$$V_{AS} = \left[\left(\frac{f_B}{f_S}\right)^2 - 1\right] V_B.$$

Also, the ratio $f_B/f_S$ can be expressed as a factor k, which is given by:

$$k = \sqrt{1 + \frac{V_{AS}}{V_B}}.$$

$S_D$ is defined as the effective area of the diaphragm. In theory, it is simply given as $S_D = \pi a^2$, where a is the effective radius of the diaphragm. However, this is not necessarily the actual radius. Cone or dome speakers can be regarded as flat pistons (in the low frequency region of their operation) except for the surround, which is fixed at the outer edge. Hence the contribution of the surround towards the total volume displacement is less than it would be if the outer edge were free to move as a piston.

In some embodiments it may be assumed that the displacement of the surround decreases linearly from its inner edge to its outer edge. In order to allow for this, it is necessary to use a formula based upon two radii $r_1$ and $r_2$ where $r_1$ is the radius of the cone where it meets the inner edge of the surround and $r_2$ is the radius of the whole diaphragm including the surround. Often, the surround has a semicircular cross section referred to as a half roll. The effective area $S_D$ of the diaphragm can be calculated using the formula $$S_D = \frac{\pi}{3}(r_1^2 + r_1 r_2 + r_2^2)$$

Small speakers often consist of a dome surrounded by a large half roll surround referred to as the ring. In this instance, the ring behaves as a surround and $r_1$ is taken as the radius of the dome and $r_2$ is the radius of the whole diaphragm including the ring.

Once $S_D$ has been obtained or retrieved the transducer parameter monitor 103 may further in some embodiments determine the mechanical compliance of the diaphragm $C_{MS}$ (in m/N) and the total moving mechanical mass $M_{MD}$ (in kg) can be calculated using the formulae:

$$C_{MS} = \frac{V_{AS}}{\rho_0 c^2 S_D^2},$$

$$M_{MD} = \frac{1}{(2\pi f_S)^2 C_{MS}},$$

where $\rho_0$=density of air=1.18 kg/m$^3$ (at T=22° C. and $P_0=10^5$ N/m$^2$), c=speed of sound in air=345 m/s (at T=25° C. and $P_0=10^5$ N/m$^2$)

Alternatively (and perhaps more intuitively) in some other embodiments the transducer parameter monitor 103 may further in some embodiments determine the values according to:

$$C_{MS} = \frac{V_{AS}}{\gamma P_0 S_D^2}$$

where γ=specific heat ratio for air=1.4, and $P_0$=static pressure=$10^5$ N/m$^2$.

Also the transducer parameter monitor 103 may further in some embodiments determine the magnetic flux and voice coil length product, known as the BI factor, using the formula $$BI = \sqrt{\frac{R_E}{2\pi f_S C_{MS} Q_{ES}}}$$

In some embodiments the transducer parameter monitor 103 may determine the frequency response of the transducer 11 by monitoring the captured microphone audio signals, which may be captured with microphone 107. In such embodiments the measurement would be in the acoustic domain and therefore other environmental aspects may contaminate the measurement. In some embodiments to minimize or reduce the environmental contamination, the apparatus may be placed inside the sale package/box. This could encourage the user of the apparatus to save their sale package. In some embodiments the sale package could be designed to enable this acoustic measurement, for example, internally arranged cavities or sound channels between the transducer 11 and microphone to permit the coupling of the acoustic waves from the transducer 11 to the microphone.

In such embodiments where the same measurement conditions are maintained, for example same microphone, loudspeaker, sale box, internal mechanic cavities, the resultant captured audio signal would only change when any internal mechanical parameters have changed (for example due to leaks, gasket failures). In such embodiments the resultant captured audio signals would produce a snapshot of the 'health' of the mechanical audio system which may be analysed in a manner similar to the following examples where any deviation from the norm is detected.

In some other embodiments, the transducer parameter monitor 103 could receive an audio signal from either the apparatus microphone 107 or a microphone external to the apparatus. In other words the transducer parameter monitor is configured in some embodiments to determine the transducer performance based on an acoustic domain indicator rather than the electrical domain indicator used by the transducer parameter monitor in some other embodiments. In the acoustic domain indicator embodiments where the apparatus microphone 107 is used the transducer parameter monitor 103 may allow for or the microphone may be designed to reduce apparatus mechanical vibrations. In further embodiments the transducer parameter monitor 103 may use echo cancellers which are important in speech call where both microphone and loudspeaker are simultaneously active, but may be deactivated in the calibration mode to enable internal vibration/acoustic signal measurements. For example if a leakage occurs due to the failure of a gasket, the internal acoustic pressure which is inside the apparatus could be less and even produce less mechanical vibration because the stiffness inside the air cavity would be reduced due to leakage. This change may then be measured.

The operation of playing the calibration audio signal and monitoring the transducer response is shown in FIG. 6 by step 603.

The transducer parameter monitor 103 may then output the parameters to the signal processing controller 105.

The operation of outputting the parameters is shown in FIG. 6 by step 605.

The operation of determining/monitoring the transducer is shown in FIG. 3 by step 303.

The signal processing controller 105 on receiving the parameters, which in some embodiments is the transducer impedance or transducer impedance frequency response then compares the current parameters against a set of stored parameters. In some embodiments the stored parameters comprises the original design specification parameters on which any software (SW) design was based. For example the original design specification parameters comprise the expected parameters of the transducer impedance when all of the hardware components are correctly integrated. In some other embodiments the signal processing controller 105 may be configured to retrieve from memory 18 or an signal processing controller 105 parameter memory a last known parameter configuration (for example the parameter configuration stored following the last calibration mode operation).

The operation of comparison of the difference between a current and previous parameter set is shown in FIG. 3 by step 305.

The signal processing controller 105 then in some embodiments determines if the difference between a current and previous parameter set is significant. In some embodiments, this may be a threshold event whereby the difference is compared for either an amplitude difference or a frequency peak difference. In other embodiments an error function may be calculated between the differences and significance determined by the error function being greater than a predetermined value. For example in some embodiments the difference may be determined to be significant where the impedance frequency response peak frequency shift is greater than 20 Hz.

For example, a loudspeaker that has a sealed back cavity and front resonator, then the frequency response of the loudspeaker would typically generate two response peaks across frequency response (frequency response measured in acoustic domain). The first peak is dependent on the sealed rear cavity (for a particular transducer, for example 900 Hz. Where the impedance response of this loudspeaker (electrical domain), then the peak in impedance response may also occur at 900 Hz. A broken seal may shift this peak relative to the change in mechanical design. Due to the measurement errors, in some embodiments a tolerance band is defined and any change in this tolerance band could be assumed as being insignificant. In some embodiments the peak location remained the same but the Level may change. A similar tolerance band thus may be defined in some embodiments for the peak level.

However, it should be noted that such changes in impedance peaks could be influenced by other parameters, for example change in front cavity and/or outlet.

In some alternative embodiments, the system may perform multiple measurement cycles and then determine the average to reduce the effect of environmental contamination on the testing processes.

The operation of determination of whether the difference is significant is shown in FIG. 3 by step 307.

The signal processing controller 105 on determining that the difference is not significant may end the calibration mode.

The operation of ending the calibration mode is shown in FIG. 3 by step 311.

The signal processing controller 105 on determining that the difference is significant may then determine a new set of parameters to be passed to the transducer control module 101. For example in some embodiments the signal processing controller 105 may from the impedance load frequency response determine a new set of equalization filter parameters for the transducer control module 101. Any suitable equalization filter parameter design algorithm may be applied.

The operation of determination of the filter parameters/coefficients from the current impedance frequency responses is shown in FIG. 3 by step 309.

The signal processing controller 105 in some embodiments then passes the new filter coefficients to the transducer control module 101.

The operation of passing the updated filter coefficients is shown in FIG. 3 by step 313.

The sound generating module 19 in some embodiments comprises a transducer control module 101, configured to receive audio signals to the sound generating module and output audio signals to the transducer 11 for reproduction. In other words the transducer control module 101 controls the audio characteristics for the transducer 11. In some embodiments this may be considered to be the software implementation part or phase of the playback speaker design. Such embodiments attempt to produce a signal which is equalized with respect to the hardware implementation speaker design to produce a frequency response approximating to frequency responses of much larger cavity volumes than available to the hardware integration designer. With respect to FIG. 4 the operation of the transducer control module 101 is shown in further detail.

The transducer control module 101 is in some embodiments configured to receive audio signals to be passed to the transducer.

The operation of receiving audio signals is shown in FIG. 4 by step 201.

The transducer control module 101 may then in some embodiments receive filter parameter values from the signal processing controller 105. The transducer control module 101 in these embodiments then digitally signal processes the received audio signals dependent on the parameters passed from the signal processing controller 105.

The operation of filtering the signal is shown in FIG. 4 by step 203.

The transducer control module 101 in some embodiments then outputs the processed audio signal to the transducer.

The operation of outputting the signal is shown in FIG. 4 by step 205.

Although the transducer control module 101 is shown and described above as performing an equalization operation on the received audio signals it would be appreciated that any suitable audio processing operation may be performed and furthermore controlled via suitable parameters determined within the signal processing controller 105. For example dynamic range control may be implemented in some embodiments to protect the transducer from overloading.

In the embodiments as shown above it can be seen that there may be an improvement in that in entering a calibration mode an automatic software update may be performed within the apparatus. Thus in some embodiments a new parametric and adaptive software equalisation design may be generated. In such embodiments any aging or degrading of components due to use may be attempted to be allowed for. Furthermore when possible any small changes to the audio system due to slight damage may also be allowed for. Similarly any analogue gain or speaker protection processing may be adaptively modified dependent on the measured parameters in the calibration mode.

In some embodiments a change due to failures or defects could be determined as being 'heavy', meaning that the system should not update the playback parameters. In these embodiments there would not be a filter or software update. In some embodiments the determination of whether the failure is a 'heavy' failure is based on a threshold or a predefined limit.

Figure 5:
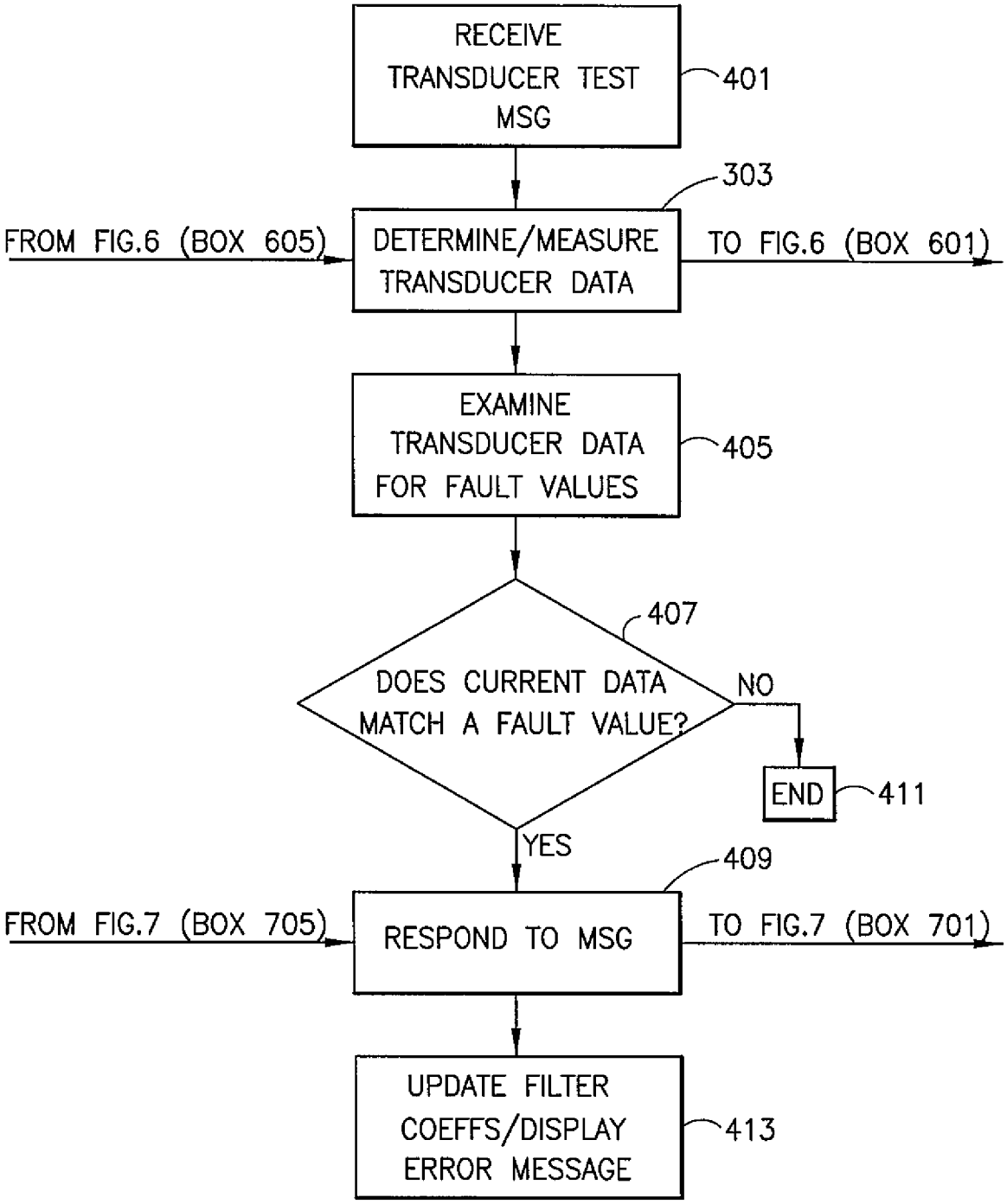
FIG. 5 shows a flow diagram of operations performed by the apparatus according to some further embodiments.
Figure 7:
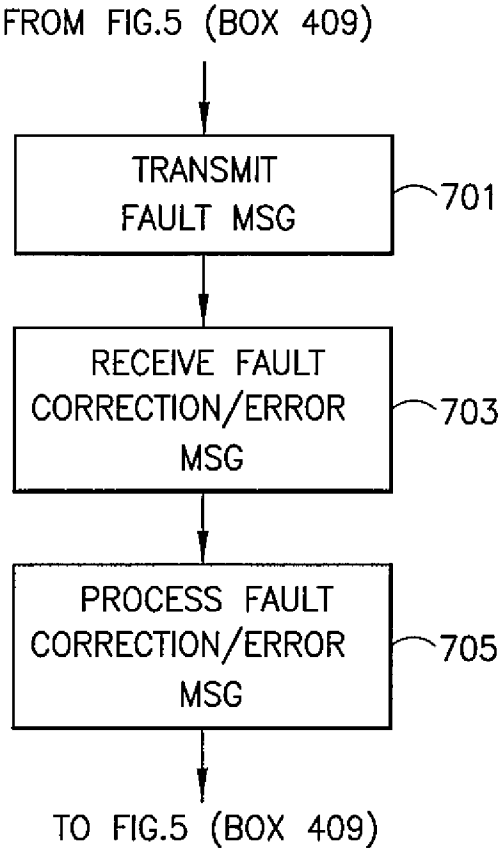
FIG. 7 shows a flow diagram of fault reporting operations performed by the apparatus according to some embodiments.

With respect to FIGS. 5 and 7 some further embodiments are described which show how some embodiments may be used not only to monitor and improve the apparatus but also provide useful information to the manufacturer to diagnose common problems with respect to the apparatus.

The apparatus in the embodiments shown with respect to FIG. 5 may be triggered to enter a calibration/diagnosis mode of operation on receipt of a transducer test message, for example a SMS message transmitted from a remote diagnosis server. However it would be appreciated that the apparatus may be configured to enter the calibration/diagnosis mode dependent on any suitable trigger event similar to those described above.

The reception of the transducer test message is shown in FIG. 5 by step 401.

The transducer parameter monitor 103 may then perform a transducer test to determine or measure the relevant transducer data in a manner similar to that described above, such as selecting a suitable calibration audio signal, playing the calibration signal and monitoring the response and outputting the response to the signal processing controller 105.

The operation of determining/monitoring the transducer is shown in FIG. 5 by step 303.

The signal processing controller 105 on receiving the parameters, which in some embodiments is the transducer impedance or transducer impedance frequency response then compares the current parameters against a set of stored parameters which have know associated faults. For example in some embodiments the memory contains a series of previously know faulty parameter values. For example where the transducer is one of a faulty batch of transducers or where a seal or gasket is missing.

The operation of comparison of the comparing the transducer data against a faulty parameter set is shown in FIG. 5 by step 405.

The signal processing controller 105 then in some embodiments identifies whether a fault match has been made. The operation of determination of a fault match is shown in FIG. 5 by step 407.

In some embodiments the signal processing controller 105 may be configured to transmit via the transceiver 13 the transducer data to be analysed by further apparatus. For example the signal processing controller 105 may transmit the transducer data to a linked personal computer or a remote diagnosis and fault detecting server. In such embodiments the operation of fault detection and response up to the operation of receiving a fault correction/error message is processed remotely from the apparatus in order to reduce the processing and memory requirements of the apparatus.

The signal processing controller 105 on determining that there is not a fault match in some embodiments ends the calibration mode. In some other embodiments the signal processing controller 105 may respond to the original transducer test message with a null of no fault indicator.

The operation of ending the calibration mode Is shown in FIG. 4 by step 411.

The signal processing controller 105 on determining that there is a fault match then in some embodiments responds to the transducer test message.

The operation of responding to the transducer test message is shown in FIG. 5 by step 409. Although the following is described with respect to a response to the transducer test message it would be appreciated that similar actions may be performed by the signal processing controller 105 in those embodiments which initiate the calibration mode without the assistance of further apparatus transmitting an transducer test message.

Furthermore with respect to FIG. 7 the operation of responding to the transducer test message is shown in further detail.

The signal processing controller 105 responds to the transducer test message by passing back a fault message. The fault message in some embodiments may comprise a fault indicator or fault code.

The operation of transmitting the fault message is shown in FIG. 7 by step 701.

The further apparatus such as a remote diagnosis server may then process the message and determine whether there is a software update available to correct the problem or whether the fault is not correctable using software.

The further apparatus may then transmit back to the apparatus a fault correction/error message which is received by the apparatus.

The receiving of the fault correction/error message is shown in FIG. 7 by step 703.

The signal processing controller 105 may then process the fault correction/error message. In some embodiments the fault correction/error message may be a SMS message which when 'saved' by the user of the device passes a set of filter parameters to the signal processing controller 105, which may store the values and pass the values on to the transducer control module 101 to attempt to allow for the fault in a manner similar as described above.

In some embodiments the signal processing controller 105 may process the fault correction/error message by displaying to the user a message requesting the apparatus be returned to a service centre for further analysis or indicating to the service centre where specifically the fault is.

The operation of processing, the fault correction/error message is shown in FIG. 7 by step 705.

The operation of updating filter coefficients/displaying an error message is shown in FIG. 5 by step 413.

In some of the above embodiments the measured characteristics of the transducer are provided to service centres via an over the air interface. In such embodiments the service centres could analyse and reply to the SMS by sending the updated design parameters over the air or if the fault is not rectifiable by a simple software update request the apparatus to be brought to the service centre to analyse the problem, add the fault to the list of known faults to assist the diagnosis and repair of the apparatus.

In some embodiments of the application there is the opportunity to monitor component life cycles and also the possibility of updating audio software design settings which are relative to any hardware change.

It may be that reference parameters are stored in memory and the measured response is compared against those reference values. Within certain thresholds, it is possible that all system parameters could be updated automatically. This would be a unique approach because we could possibly improve the playback quality which is specific for each handset and also specific for each handset in time.

In some embodiments the initialization of the calibration mode would display a message to the user to place the apparatus in a suitable position away from the ear or any interfering surface because any interference with sound outlets of the handset would interfere with the impedance measurement. In some embodiments the user interface may guide the user to position the handset in the sale box during the calibration, which is particularly designed to keep sound outlets free to air, wherein calibration process is completed when the phone is positioned in the sale box.

In some embodiments the apparatus may determine when it is positioned at specific orientations, using sensors or accelerometers that activate the calibration process automatically as soon as the phone is positioned in the sale box.

In some apparatus at least some of the above operations may be performed through a database/server such as Nokia music store (and/or Nokia Ovi), PC Suit applications, or alternatively by the service centre and then updated parameters sent back to the apparatus.

In such embodiments it may be possible to collect and monitor data from the field for an apparatus product family so that manufacturer can understand faults which occur in the field. Such data is currently too difficult to obtain reliably as there is no return mechanism other than physically returning the product to a service centre which requires a significant amount of time and effort.

In some embodiments there may a combination of one or more of the previously described embodiments.

Thus in at least one embodiment there is a method comprising: monitoring at least one indicator dependent on a transducer mechanical integration parameter; and determining a change in the at least one indicator.

The at least one indicator may further as described above be at least one of: a transducer electrical impedance (or at least the potential across the transducer); at least one Theiele-Small parameter; and a captured audio signal generated by the transducer mechanical integration.

It shall be appreciated that the term portable device is user equipment. The user equipment is intended to cover any suitable type of wireless user equipment, such as mobile telephones, portable data processing devices or portable web browsers. Furthermore, it will be understood that the term acoustic sound channels is intended to cover sound outlets, channels and cavities, and that such sound channels may be formed integrally with the transducer, or as part of the mechanical integration of the transducer with the device.

In general, the various embodiments may be implemented in hardware or special purpose circuits, software, logic or any combination thereof. Some aspects of the invention may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware.

Thus in some embodiments there is an apparatus comprising at least one processor and at least one memory including computer program code the at least one memory and the computer program code configured to, with the at least one processor, cause the apparatus at least to perform: monitoring at least one indicator dependent on a transducer mechanical integration parameter; and determining a change in the at least one indicator.

For example, in some embodiments the method of manufacturing the apparatus may be implemented with processor executing a computer program.

Thus in at least one embodiment comprises a computer-readable medium encoded with instructions that, when executed by a computer perform: monitoring at least one indicator dependent on a transducer mechanical integration parameter; and determining a change in the at least one indicator.

Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims. Indeed in there is a further embodiment comprising a combination of one or more of any of the other embodiments previously discussed.

The invention claimed is:

1. An apparatus comprising:

at least one processor, and at least one non-transitory memory including computer program code, the at least one memory and the computer program code configured to, with the at least one processor, causes the apparatus at least to:

receive an audio signal using at least one microphone inside the apparatus, where the received audio signal corresponds to acoustic output of an audio transducer inside the apparatus;

determine a physical condition of an audio transducer mechanical integration of the audio transducer in relation to a predetermined physical condition of the audio transducer mechanical integration based on the received audio signal and a driving signal, wherein the acoustic output is based on the driving signal; and provide at least one status information for the audio transducer mechanical integration based on the determined physical condition of the audio transducer mechanical integration.

2. The apparatus as in claim 1, wherein determination of the physical condition of the audio transducer mechanical integration comprises at least one of:

determination that a difference between the received audio signal and a previously received audio signal exceeds a first threshold value, wherein the previously received audio signal corresponds to the audio output of the audio transducer; or determination that there is at least a partial match between the received audio signal and at least one of a set of predetermined audio signals, where the set of predetermined audio signals identifies one or more audio mechanical integration faults.

3. The apparatus as in claim 2, wherein the first threshold value comprises at least one of:

a difference in amplitude; or a difference in at least one frequency range.

4. The apparatus of claim 1, wherein the at least one memory and the computer program code are configured to, with the at least one processor, cause the apparatus at least to:

cause deactivation of at least one feature associated with the at least one microphone while the audio signal is being received.

5. The apparatus of claim 4, wherein the at least one feature comprises at least one of:

an echo cancellation feature; or mechanical vibration reduction feature.

6. The apparatus of as in claim 1, wherein the provision of the at least one status information comprises at least one of:

transmission of the at least one status information to at least one of:

another device, a personal computer, a database, or a server; or storing of the at least one status information in the at least one memory.

7. The apparatus as in claim 1, wherein the at least one memory and the computer program code are configured to, with the at least one processor, cause the apparatus at least to:

determine at least one rectification parameter to compensate for the physical condition of the audio transducer mechanical integration of the audio transducer; and cause the at least one rectification parameter to be applied so as to optimize audio output with the audio transducer.

8. The apparatus as in claim 7, wherein the at least one determined rectification parameter comprises at least one equalization filter coefficient, wherein causing the at least one rectification parameter to be applied causes at least filtering of a first audio signal prior to using the at least one equalization filter coefficient prior to playing the first audio signal.

9. The apparatus as in claim 7, wherein determination of the at least one rectification parameter comprises reception of the at least one rectification parameter from another device, personal computer, database, and/or server in response to the provision of the at least one status information.

10. The apparatus as in claim 1, wherein the at least one status information indicates at least one of:

whether the physical condition of the audio transducer mechanical integration is an abnormal condition; or one or more parameters based on the received audio signal.

11. The apparatus as in claim 1, wherein determination of the physical condition of the audio transducer mechanical integration comprises:

determination of one or more parameters associated with the received audio signal, and comparison of the one or more parameters of the received audio signal to one or more previously determined reference parameters.

12. The apparatus as in claim 1, wherein the audio transducer is at least one of:

a loudspeaker, an integrated hands-free speaker, or an earpiece speaker.

13. A method comprising:

receiving an audio signal using at least one microphone inside a portable electronic device, where the received audio signal corresponds to acoustic output of an audio transducer inside the portable electronic device;

determining a physical condition of an audio transducer mechanical integration of the audio transducer in relation to a predetermined physical condition of the audio transducer mechanical integration based on the received audio signal and a driving signal, wherein the acoustic output is based on the driving signal; and providing at least one status information for the audio transducer mechanical integration based on the determined physical condition of the audio transducer mechanical integration.

14. The method as in claim 13, wherein determining the physical condition of the audio transducer mechanical integration comprises at least one of:

determining that a difference between the received audio signal and a previously received audio signal exceeds a first threshold value, wherein the previously received audio signal corresponds to the audio output of the audio transducer; or determining that there is at least a partial match between the received audio signal and at least one of a set of predetermined audio signals, where the set of predetermined audio signals identifies one or more audio mechanical integration faults.

15. The method as in claim 14, wherein the first threshold value comprises at least one of:

a difference in amplitude; or a difference in at least one frequency range.

16. The method of claim 13, further comprising:

causing deactivation of at least one feature associated with the at least one microphone while the audio signal is being received.

17. A non-transitory computer readable medium encoded with instructions that, when executed with a computer, causes the computer to:

receive an audio signal using at least one microphone inside a portable electronic device, where the received audio signal corresponds to acoustic output of an audio transducer inside the portable electronic device;

determine a physical condition of an audio transducer mechanical integration of the audio transducer in relation to a predetermined physical condition of the audio transducer mechanical integration based on the received audio signal and a driving signal, wherein the acoustic output is based on the driving signal; and provide at least one status information for the audio transducer mechanical integration based on the determined physical condition of the audio transducer mechanical integration.

* * * * *